US005555586A

United States Patent [19]

Dorrich et al.

[11] Patent Number: 5,555,586

[45] Date of Patent: Sep. 17, 1996

[54] SELF-CONTAINED PORTABLE GOLF BALL WASHING UNIT

[76] Inventors: Allen Dorrich, 9021 Sahler, Brookfield, Ill. 60513; Willis D. Fillers, 10105 - 107 Cut-Off, Greeneville, Tenn. 37743

[21] Appl. No.: 524,840

[22] Filed: Sep. 7, 1995

[51] Int. Cl.[6] ..... A63B 47/04

[52] U.S. Cl. ..... 15/21.2; 15/104.92; 15/106; 15/160

[58] Field of Search ..... 15/21.2, 104.92, 15/106, 114, 118, 160

[56] References Cited

U.S. PATENT DOCUMENTS

| | | | |
|---|---|---|---|
| 1,320,633 | 11/1919 | Minkler . | |
| 1,747,724 | 2/1930 | Mollart . | |
| 1,758,011 | 5/1930 | Reach . | |
| 1,781,113 | 11/1930 | Laing | 15/21.2 |
| 1,859,626 | 5/1932 | Laing | 15/21.2 |
| 1,918,529 | 7/1933 | Frater | 15/21.2 |
| 2,023,932 | 12/1935 | Meikle . | |
| 2,807,037 | 9/1957 | Garske | 15/21.2 |
| 2,822,558 | 2/1958 | Vandervort et al. . | |
| 3,044,089 | 7/1962 | Boynton . | |
| 3,101,497 | 8/1963 | Derkocz . | |
| 3,119,533 | 1/1964 | Kimes | 15/21.2 |
| 3,271,802 | 9/1966 | Thompson | 15/21.2 |
| 3,304,659 | 2/1967 | Eichhorn | 15/21.2 |
| 3,583,016 | 6/1971 | McConnell . | |
| 3,678,526 | 7/1972 | Burkholder . | |
| 3,748,676 | 7/1973 | Warren | 15/21.2 |
| 3,800,095 | 4/1968 | Piper, Jr. . | |
| 4,210,974 | 7/1980 | Stoltzman . | |
| 4,344,203 | 8/1982 | Gerrick . | |
| 4,750,232 | 6/1988 | Doney . | |
| 4,945,596 | 8/1990 | Chang et al. . | |
| 4,965,906 | 10/1990 | Mauro | 15/21.2 |
| 5,081,735 | 1/1992 | Wyatt | 15/21.2 |
| 5,308,406 | 5/1994 | Wallock | 15/21.2 |

FOREIGN PATENT DOCUMENTS

| | | | |
|---|---|---|---|
| 2695844 | 3/1994 | France | 15/21.2 |
| 0007804 | of 1908 | United Kingdom | 15/21.2 |

*Primary Examiner*—David Scherbel
*Assistant Examiner*—Randall E. Chin
*Attorney, Agent, or Firm*—Dennison, Meserole, Pollack & Scheiner

[57] ABSTRACT

A portable golf ball washing device includes a generally elongated cylindrical container within which a pair of bristle modules are disposed with the bristles of each module including a short bristle segment and a long bristle segment to define two separate concentric zones within the container. A ball carrying paddle is provided with a ball receiving opening adjacent one end thereof and a closure member with appropriate handle means attached thereto at the opposite end. The paddle is dimensioned to extend into the receptacle and support the ball for rotative movement during the washing action. An appropriate cleaning solution is disposed within the container for assisting in the washing action when the paddle is moved longitudinally of the container and the ball engages the several bristle zones.

1 Claim, 2 Drawing Sheets

SELF-CONTAINED PORTABLE GOLF BALL WASHING UNIT

BACKGROUND OF THE INVENTION

This invention relates to devices used for cleaning golf balls and in particular is directed to a portable self-contained unit within which a golf ball may be positioned for engagement with brush modules and appropriate cleaning solution to apply a cleaning action to the ball to remove dirt and other foreign objects from the surface of the ball. The device is particularly configured and designed to be carried as an accessory item by the player and may be attached to the player's belt or any of the other play accessories, such as a golf cart or a golf car as well as the conventional bag within which the clubs are normally contained.

The applicant is aware of the following prior art golf ball cleaners:

| | |
|---|---|
| 1,320,633 | Minkler |
| 1,747,724 | Mollart |
| 1,758,011 | Reach |
| 2,023,932 | Meikle |
| 2,822,558 | Vandervort et al |
| 3,044,089 | Boynton |
| 3,101,497 | Derkocz |
| 3,380,095 | Piper, Jr. |
| 3,583,016 | McConnell |
| 3,678,526 | Burkholder |
| 4,210,974 | Stoltzman |
| 4,344,203 | Gerrick |
| 4,750,232 | Doney |
| 4,945,596 | Chang et al |

SUMMARY OF THE INVENTION

All of the patents noted above disclose golf ball cleaners of general construction and some include internal brushing components engaging the ball when the same is reciprocated within the appropriate container. None of these prior art references, and no other prior art of which applicant is aware, utilize a coaxial pair of cleaning sections within the container defined by differing lengths of the brush modules so that a ball may be subjected to cleaning action of two different intensities.

It is well recognized that during the course of play, golf balls become subjected to contamination from the environmental elements such as mud, water, dirt, debris, grass clippings, etc., and that such contamination can have a deleterious effect on the flight of the ball. Accordingly, it is desirable to insure the best possible playing action by utilizing a relatively clean ball. To be able to clean the ball at various times throughout the play is recognized as a desirable activity.

Complex devices, as exemplified by some of the prior art, are both cumbersome and awkward, thus finding disfavor with players and falling into disuse. Applicant's device, on the other hand, is both lightweight and quite efficient in achieving the desired purpose and as indicated, may be carried on the ancillary equipment normally accompanying the golfer during his round of play or may be carried on a belt loop attached to the player's clothing.

Accordingly, it is an object of the invention to facilitate the cleaning of golf balls prior to, during, or following play in order to minimize the debris normally accumulated on the surface of the ball.

It is a further object of the invention to facilitate transport of the cleaning device so that it is always readily at hand and available for use when needed. The foregoing objects and other benefits and advantages will be understood by a consideration of the illustrations of the invention as set forth in the drawings and as more fully described by the specification and claims appended.

BRIEF DESCRIPTION OF THE DRAWINGS

Attention is now directed to the drawings wherein like reference numerals refer to like parts throughout the several views and wherein.

DESCRIPTION OF PREFERRED EMBODIMENTS

Figures 1, 2:
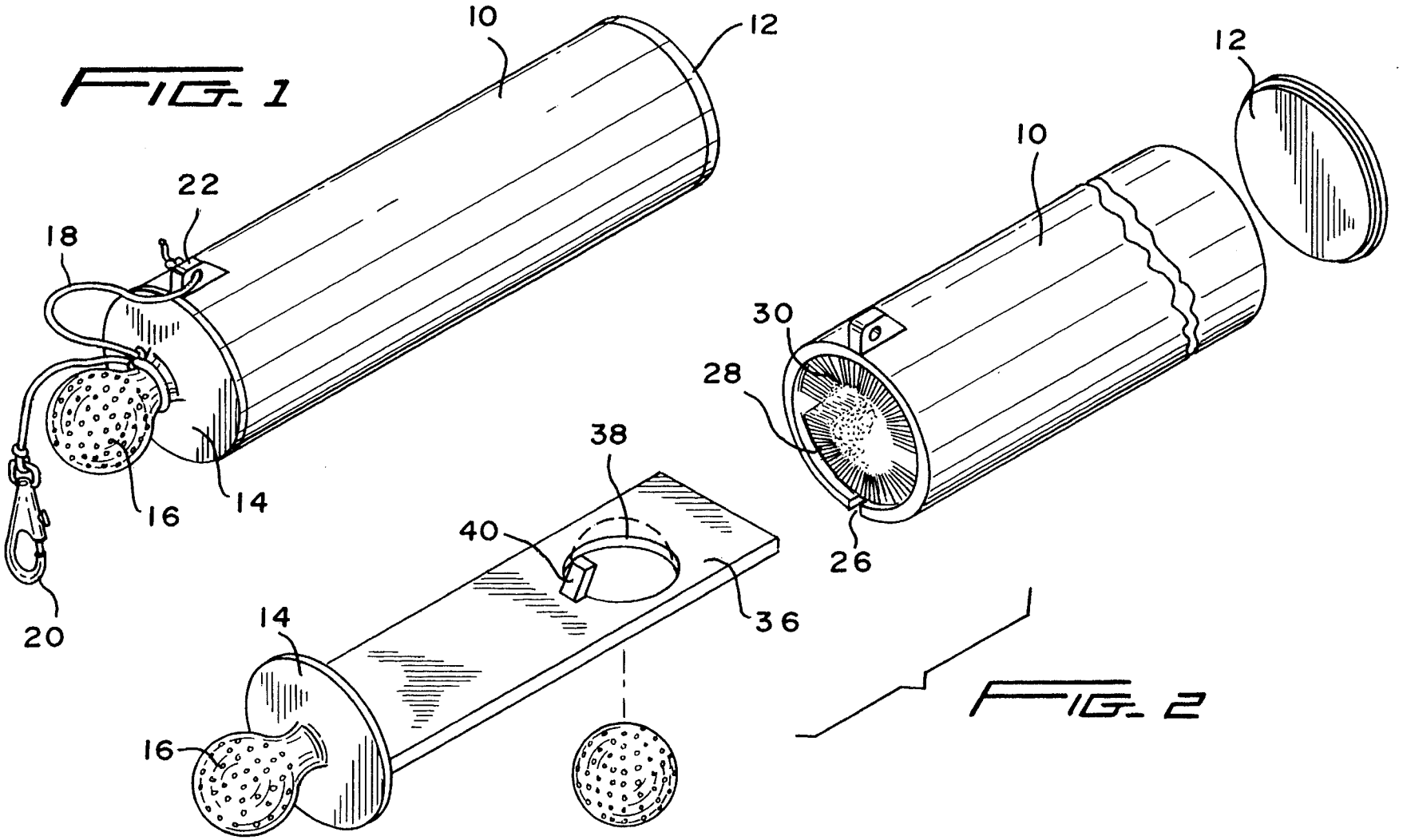
FIG. 1 is a perspective view of the portable ball washing device in its assembled configuration.
FIG. 2 is an exploded perspective view illustrating the paddle and ball retention means withdrawn from the interior of the container.

Referring now more specifically to FIG. 1, the ball washer of the invention includes a generally cylindrical tubular washer body 10 closed at its bottom 12 and provided with a sealing closure cap 14 at its opposite end. The closure includes a decorative handle 16 which may be in the form of a simulated golf ball and a lanyard 18 which is employed to attach the unit to the golfer or to an ancillary piece of golfing equipment. One end of the lanyard 18 includes a snap hook 20 and the opposite end is tethered to the container via the lug 22 affixed thereon.

The closure cap 14 includes appropriate sealing means (not shown) together with a latching lug 24 positioned within an appropriate latching recess 26.

Opposite pairs of elongated brush modules 28, 30, 32 and 34 of arcuate configuration are positioned within and secured to the walls of the container to define a central open core extending from one end of the container to the other. The brush modules are positioned within the container in spaced relation to each other to define between their longitudinal edges, track or guide slots 29, 31 to be discussed more fully hereinafter.

Figure 3:
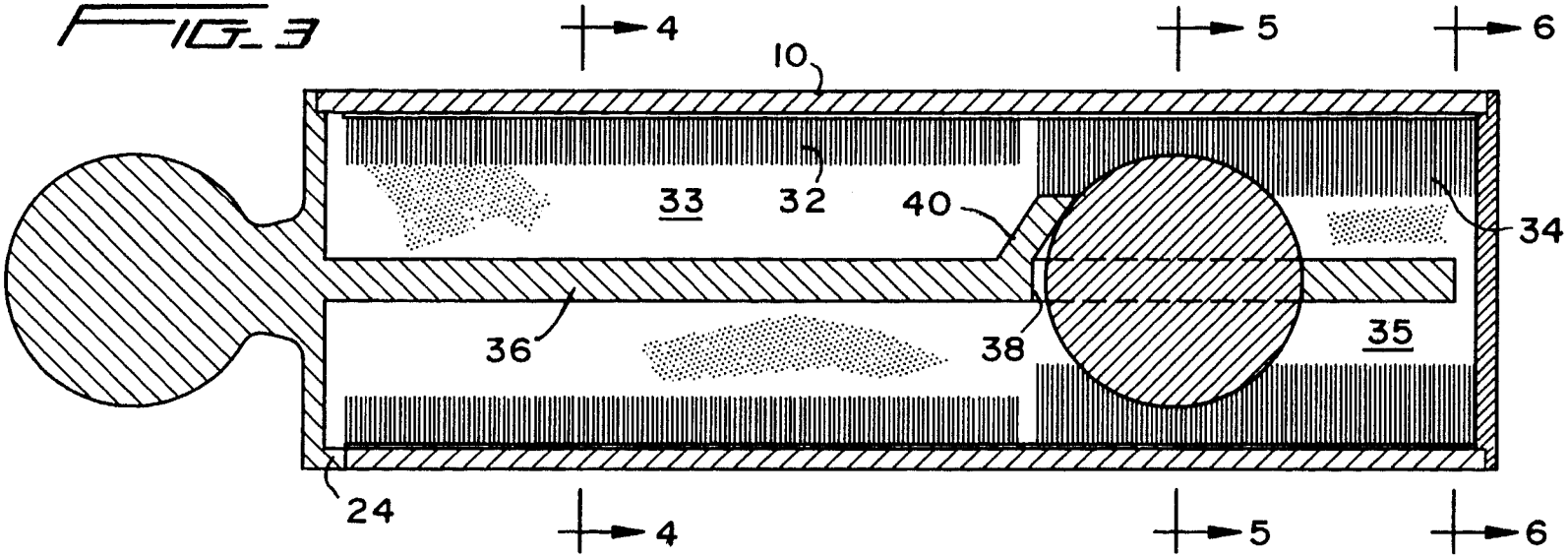
FIG. 3 is a longitudinal sectional view of the ball washer of the invention illustrating the ball in position within the container and within the ball retaining paddle.
Figure 6:
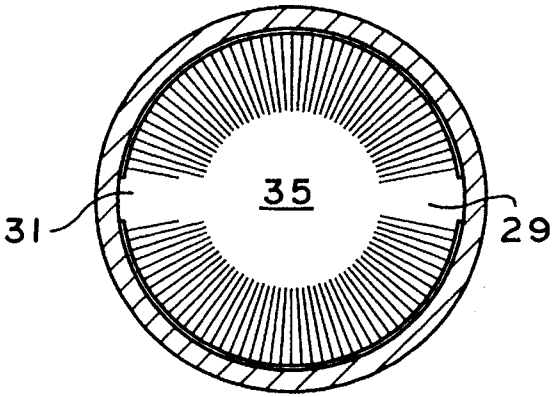
FIG. 6 is a cross-sectional view of the device taken along the lines 6—6 of FIG. 3.
Figure 5:
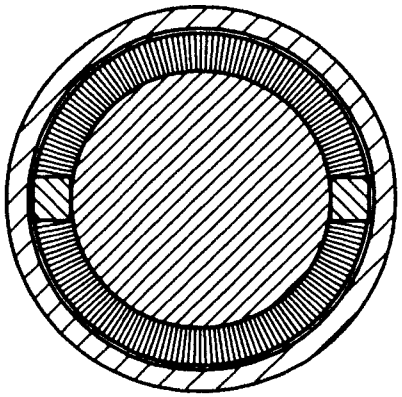
FIG. 5 is a cross-sectional view of the device taken along the lines 5—5 of FIG. 3.
Figure 4:
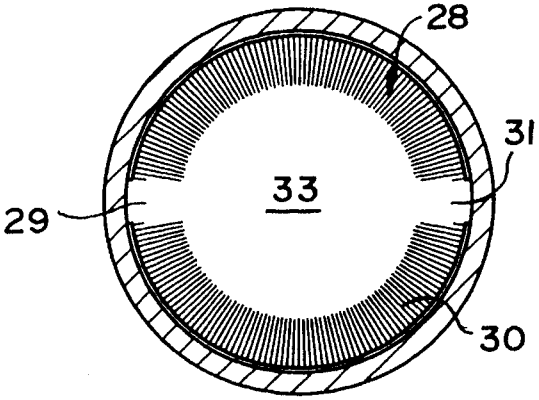
FIG. 4 is a cross-sectional view of the device taken along the lines 4—4 of FIG. 3.

The bristle modules are formed with bristles of two separate lengths. Two short bristle module sections 30, 28 will be seen best in FIG. 3 to define the core portion 33 as having a dimension slightly less than that of a conventional golf ball. A second set of bristle modules 32, 34 define a core 35 of considerably lesser dimension than a conventional golf ball. The handle 16 and top 14 of the device are affixed to an elongated paddle 36 which includes a ball receiving opening 38 adjacent one end thereof and a ball retention lug 40 extending over a portion of one side of the ball opening. The paddle is of generally rectangular configuration and is dimensioned to extend between the longitudinal edges of the bristle modules within the tracks 29, 31 and is configured to be reciprocated within the container 10, thus positioning the ball initially in contact with the short bristle modules 28,30 and ultimately in contact with the long bristle modules 32,34 when a reciprocating action is applied to the handle to effect the washing procedure. Thus, cleaning fluid (not shown) contained within the container and on the several bristle modules will assist in the cleaning action effected by the contact with the ball carried by the paddle and retained in position by the lug 40. After a manipulation of the paddle several times, the ball may be withdrawn from the housing and discharged into the hands of the player for application of appropriate drying means.

When required, the brush modules may be replaced by simply removing the closure cap 14 and/or the bottom 12 for access to the individual brush modules.

Repositioning the paddle and top closure in the position illustrated in FIG. 1 will render the device ready for the next cleaning action when needed. Meanwhile, the cleaning fluid will be retained within the container.

It is within the contemplation of the inventor that this entire unit may be fabricated from any suitable material, such as metal or plastic, and that the brush modules may be removed and replaced as needed.

While the invention has been described in accordance with the illustrated preferred embodiment, it is within the contemplation of the invention that other shapes of the various components may be employed all within the scope of the claims appended hereto.

We claim:

1. A portable self-contained golf ball washer including a generally cylindrical washer body closed at one end and open at the other; a closure member positioned to sealingly overlie the open end of the washer body and including an external handle portion and an internal paddle portion, said paddle configured to extend within and substantially to the closed end of the washer body, first and second brush modules shaped to conform to the interior of the washer body and positioned therewithin in longitudinal spaced relation to each other along their respectively longitudinal edges for substantially the full length of the washer body, wherein said first brush module includes bristles configured to extend into said washer body to a first depth and said second brush module includes bristles configured to extend into said washer body to a different depth than the bristles of said first brush module, the bristles of said first and second modules collectively defining a central circular core within said washer body of two different diameters, said brush modules configured to define by their respective longitudinal edges a space also extending substantially the full length of the washer body, such spaced module edges defining therebetween a track configured to accommodate at least one edge of the paddle when the paddle is inserted to a position within the washer body, and ball retention means in said paddle including a ball receiving opening and a ball retention lug extending partially thereover.

* * * * *